US006826918B1

(12) United States Patent
Taras et al.

(10) Patent No.: US 6,826,918 B1
(45) Date of Patent: Dec. 7, 2004

(54) REFRIGERANT SYSTEM PERFORMANCE ENHANCEMENT BY USE OF ADDITIONAL HEAT EXCHANGER

(75) Inventors: Michael F. Taras, Fayetteville, NY (US); Alexander Lifson, Manlius, NY (US); Howard H. Fraser, Jr., New Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/732,565

(22) Filed: Dec. 10, 2003

(51) Int. Cl.[7] ..... F25B 1/00
(52) U.S. Cl. ..... 62/115; 62/498; 62/524
(58) Field of Search ..... 62/117, 181, 197, 62/199, 498, 524, 115

(56) References Cited

U.S. PATENT DOCUMENTS 4,876,859 A 10/1989 Kitamoto
4,903,495 A * 2/1990 Howland et al. ..... 62/81
5,875,637 A 3/1999 Paetow
6,047,556 A 4/2000 Lifson
6,058,727 A * 5/2000 Fraser et al. ..... 62/190
6,206,652 B1 3/2001 Caillat
6,651,451 B2 * 11/2003 Cho et al. ..... 62/197

OTHER PUBLICATIONS

Systems & Advanced Technologies Engineering S.r.I., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Melvin Jones
(74) *Attorney, Agent, or Firm*—Carlson, Gaskey & Olds

(57) ABSTRACT

The invention provides two distinct schematics allowing system performance enhancement through the utilization of an auxiliary heat exchanger and splitting the refrigerant flow into primary and secondary paths. A system performance boost is achieved due to extra subcooling of a primary refrigerant flow in an auxiliary heat exchanger as well as superheat reduction of the combined refrigerant flow entering the compressor and a primary refrigerant flow pressure drop decrease through the evaporator (in comparison to the prior art). The invention offers the superior benefits outlined above with only a moderate cost increment. Also, employment of conventional components only, and no compressor modifications make implementation of the proposed schematics even more attractive.

11 Claims, 1 Drawing Sheet

REFRIGERANT SYSTEM PERFORMANCE ENHANCEMENT BY USE OF ADDITIONAL HEAT EXCHANGER

BACKGROUND OF THE INVENTION

This application relates to refrigerant cycles wherein performance enhancement is achieved by the use of an additional heat exchanger, and a split in the refrigerant flow. The disclosed embodiments provide performance enhancement not unlike an economizer cycle, but without the requirement of modification of the compressor.

Refrigerant cycles are utilized to provide cooling or heating. In a conventional refrigerant cycle, a compressor compresses a refrigerant and delivers a compressed refrigerant to a downstream condenser. From the condenser, the refrigerant passes through an expansion device, and from the expansion device to an evaporator. The refrigerant from the evaporator is returned to the compressor. The condenser may also be known as an outdoor heat exchanger and the evaporator as an indoor heat exchanger, when the system operates in a cooling mode. In a heating mode, their functions are reversed.

A refrigerant cycle is able to provide a certain amount of cooling or heating, known as the capacity. One way to increase the capacity of a refrigerant cycle is the use of an economizer circuit. In an economizer circuit, flow downstream of the condenser is split into a main flow and a secondary flow. The secondary flow is passed through an expansion device, which lowers the temperature of the secondary flow. The secondary flow and the main flow are then both passed through an economizer heat exchanger. The main flow is thus cooled, and when it reaches the evaporator, it has an increased cooling capacity. The secondary flow is returned to an intermediate compression point in the compressor. The economizer circuit does provide performance enhancements, however, in some applications the economizer cycle has been seen as too expensive to implement. In particular, the use of the economizer cycle does require modifications to the compressor to receive the returned refrigerant at the intermediate compression point.

One other way to enhance capacity is the use of an auxiliary liquid line-t-suction line heat exchanger. In such a concept, refrigerant downstream of the condenser is passed through the auxiliary heat exchanger, and the refrigerant returning from the evaporator back to the compressor is also passed through this heat exchanger. The refrigerant returning from the evaporator to the compressor cools the refrigerant leaving the condenser, which increases system capacity. However, the amount of performance enhancement provided by such systems is not always as great as would be desirable, mainly due to an associated undesirable increase in refrigerant temperature as it enters the compressor suction port.

SUMMARY OF THE INVENTION

In disclosed embodiments of this invention, refrigerant downstream of a condenser is broken into two flow paths. The two flow paths provide a main flow and a secondary flow. An auxiliary heat exchanger is positioned downstream of the condenser. The invention includes two distinct ways of splitting and recombining the flow, as well as two distinct ways of passing refrigerant through the auxiliary heat exchanger. However, the two embodiments are common in that the combined refrigerant flow is all returned to the suction port of the compressor.

In a first embodiment, the refrigerant is split downstream of the auxiliary heat exchanger into main and secondary flow paths. The main flow passes through the expansion device and evaporator. Downstream of the evaporator, this main flow is combined with a secondary tapped flow. The secondary tapped flow passes through the auxiliary expansion device but not through the evaporator. This secondary flow is still in a two-phase state, and is predominantly a liquid. The recombined flow is then passed through the auxiliary heat exchanger. Some superheat reduction of the recombined flow as compared to the main flow occurs during this mixing. In this manner, when the combined flow passes back through the auxiliary heat exchanger, it is able to cool the refrigerant downstream of the condenser to a greater extent than the prior art. Additionally, re-routing a secondary flow around the evaporator may benefit system performance as refrigerant pressure drop in the evaporator is reduced.

In a second embodiment, the refrigerant is split downstream of the condenser but upstream of the auxiliary heat exchanger. The secondary flow is passed through an expansion device, and then passed through the auxiliary heat exchanger to cool the main flow. However, the refrigerant is returned to the main suction line leading to the compressor suction port. In this regard, it is not unlike a standard economizer circuit. This second embodiment provides similar benefits to the system performance as the first embodiment, as it also does not require modifications to the compressor.

These and other features of the present invention can be best understood from the following specification and drawings, the following of which is a brief description.

DETAILED DESCRIPTION OF THE PREFERRED EMBODIMENT

Figure 1:
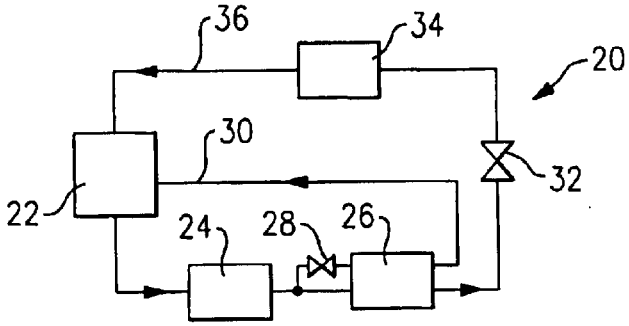
FIG.1 Prior Art
FIG. 1 shows a prior art refrigerant circuit.

FIG. 1 shows a refrigerant circuit 20 incorporating an economizer circuit. As known, a compressor 22 compresses a refrigerant and delivers it downstream to a condenser 24. Downstream of the condenser 24 is an economizer heat exchanger 26. Refrigerant is tapped through a tap line from a main refrigerant path and passes through an economizer expansion device 28. The tapped refrigerant cools the main refrigerant flow. The tapped refrigerant is returned to an intermediate compression point 30 in the compressor 22. The main flow passes through an expansion device 32, an evaporator 34, and returned to the suction line 36 leading to the suction port of the compressor 22. As mentioned above, economizer circuits do provide performance enhancements, however, they can be too expensive for certain applications.

Figure 2:
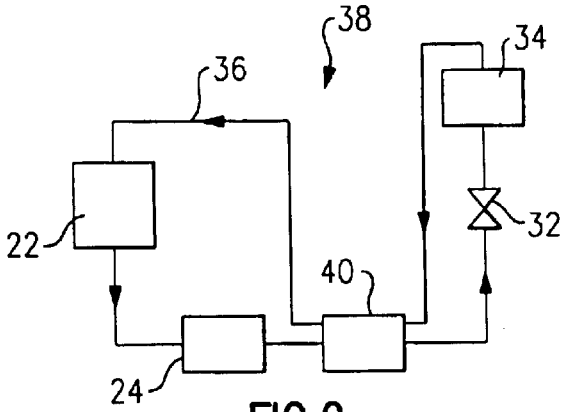
FIG.2 Prior Art
FIG. 2 shows a second prior art refrigerant circuit.

FIG. 2 shows another system configuration that provides performance enhancement. Here, an auxiliary liquid line-to-suction line heat exchanger 40 is positioned downstream of a condenser 24. Refrigerant returning from the evaporator 34 passes through the auxiliary heat exchanger 40 to cool the main refrigerant flow passing from the condenser 24 to the main expansion device 32. The refrigerant is returned through the suction line 36 to the suction port of the compressor 22. As mentioned above, while this type of prior art schematics does not carry the expense of the economizer circuit, it may not provide as much performance enhancement as would be desired.

Figure 3:
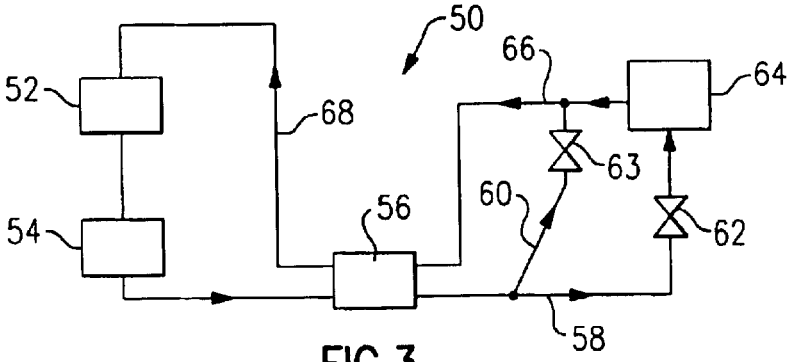
FIG. 3 shows a first embodiment of the present invention.

FIG. 3 shows the first embodiment of the present invention 50 that provides the improvement over the prior art. Here, the compressor 52 again compresses a refrigerant and delivers it to a condenser 54. An auxiliary heat exchanger 56 is positioned downstream of the condenser 54. The flow of refrigerant downstream of the condenser 54 all passes through the heat exchanger 56. Downstream of the auxiliary heat exchanger 56 the flow branches into a main flow path 58, and a secondary flow path 60. The main flow path 58 passes through a main expansion device 62, and to the evaporator 64. The secondary flow passes through its own secondary expansion device 63, where its temperature and pressure are reduced. Downstream of the evaporator 64, the flows are again merged in suction line 66. The merged flow in line 66 passes through the auxiliary heat exchanger 56, preferably in a counter-flow arrangement with flow in path 58. Since the tapped fluid in line 60 is mainly in a liquid state, it will lower the superheat of the refrigerant leaving the evaporator 64 when the two flows mix with each other. In this manner, the refrigerant passing through the auxiliary heat exchanger 56 is able to provide more cooling load to the refrigerant downstream of the condenser than the prior art FIG. 2. Additionally, the reduced pressure drop through the evaporator will also benefit the system performance. The combined flow 66 is returned to the suction line 68 leading to the suction port of the compressor 52. Refrigerant entering the suction port of compressor 52 has lower superheat than in the prior art FIG. 2, resulting in further system performance enhancement. Hence, this embodiment provides additional performance enhancement when compared to the FIG. 2 embodiment, but does not require the modifications to the compressor and other expense-raising modifications of the FIG. 1 economizer circuit.

Figure 4:
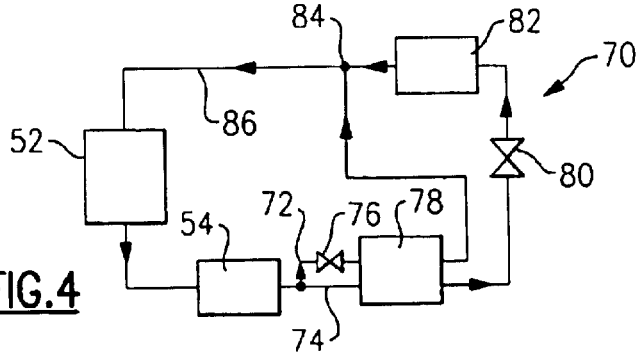
FIG. 4 shows the second embodiment of the present invention.

FIG. 4 shows another embodiment 70. Here, the flow is branched into two passes 72 and 74 downstream of the condenser 54, but upstream of the auxiliary heat exchanger 78. A main flow path 74 passes through the auxiliary heat exchanger 78, to a main expansion device 80, and to the evaporator 82. The tapped refrigerant 72 passes through an auxiliary expansion device 76, and into the auxiliary heat exchanger 78. For illustration simplicity, the two flows are shown passing through the auxiliary heat exchanger 78 in the parallel flow arrangement. However, it is preferable to have the two flows pass in a counterflow arrangement. Downstream of the auxiliary heat exchanger 78, the refrigerant in the tapped line 72 is merged at junction 84 with the refrigerant flow downstream of the evaporator 82. The merged flow is returned through the suction line 86 to the suction port of the compressor 52. This invention provides performance enhancement not unlike the economizer FIG. 1, but without the requirement of the modification to the compressor 52, in that the returned tapped refrigerant is returned to the suction line 86. This schematic provides similar benefit in terms of system performance enhancement to the schematics in FIG. 3, outlined above.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant circuit comprising:

a compressor having a discharge line leading to a condenser, said condenser having a discharge line leading to an auxiliary heat exchanger, a refrigerant flowing through said auxiliary heat exchanger passing to a main expansion device, and then to an evaporator, and then from said evaporator returning refrigerant to a suction line leading to said compressor; and refrigerant downstream of said condenser being split into a main flow path and a secondary flow path, said secondary flow path bypassing said main expansion device and said evaporator, and being recombined with said main flow path downstream of said evaporator to be returned to said suction line leading to said compressor.

2. A refrigerant circuit as set forth in claim 1, wherein said secondary flow path passes through a secondary expansion device before being recombined.

3. A refrigerant circuit as set forth in claim 1, wherein said main flow path and said secondary flow path branch away from each other downstream of said auxiliary heat exchanger, and upstream of said main expansion device.

4. A refrigerant circuit as set forth in claim 1, wherein said main flow path and said secondary flow path branch away from each other downstream of said condenser, and upstream of said auxiliary heat exchanger, said main flow path and said secondary flow path both passing through said auxiliary heat exchanger.

5. A refrigerant circuit as set forth in claim 4, wherein said secondary flow path passes through an expansion device upstream of said auxiliary heat exchanger.

6. A refrigerant circuit comprising:

a compressor having a discharge line leading to a condenser, said condenser having a discharge line leading to an auxiliary heat exchanger, a refrigerant flowing through said auxiliary heat exchanger passing to a main expansion device, and then to an evaporator, and then from said evaporator returning refrigerant to a suction line leading to said compressor; and refrigerant downstream of said condenser being split into a main flow path and a secondary flow path downstream of said auxiliary heat exchanger, and upstream of said main expansion device or said evaporator, and being recombined with said main flow path downstream of said evaporator to be returned to said compressor suction line.

7. A refrigerant circuit comprising:

a compressor having a discharge line leading to a condenser, said condenser having a discharge line leading to an auxiliary heat exchanger, a refrigerant flowing through said auxiliary heat exchanger passing to a main expansion device, and then to an evaporator, and then from said evaporator returning refrigerant to a suction line leading to said compressor; and refrigerant downstream of said condenser being split into a main flow path and a secondary flow path downstream of said compressor and upstream of said auxiliary heat exchanger, and both said main flow path and said secondary flow path passing through said auxiliary heat exchanger, and being recombined with said main flow path downstream of said evaporator to return to said compressor suction line.

8. A refrigerant circuit as set forth in claim 7, wherein said secondary flow path passes though a secondary expansion device upstream of said auxiliary heat exchanger.

9. A method of increasing performance in a refrigerant circuit comprising the steps of:

(1) providing a compressor having a discharge line leading to a condenser, the condenser having a line leading to an auxiliary heat exchanger, and a refrigerant flowing through said auxiliary heat exchanger passing to a main expansion device, then to an evaporator, and then from said evaporator returning refrigerant to a suction line leading to said compressor; and (2) splitting refrigerant downstream of condenser into a main flow path and a secondary flow path, both said main flow path and said secondary flow path passing through said auxiliary heat exchanger, said secondary flow path bypassing said main expansion device and said evaporator, and passing the refrigerant in said secondary flow path through a secondary expansion device, said secondary flow path being recombined with said main flow path downstream of said evaporator, to be returned to said suction line leading to said compressor.

10. A method of increasing performance in a refrigerant circuit comprising the steps of:

(1) providing a compressor having a discharge line leading to a condenser, the condenser having a line leading to an auxiliary heat exchanger, and a refrigerant flowing through said auxiliary heat exchange passing to a main expansion device, then to an evaporator, and then from said evaporator returning refrigerant to a suction line leading to said compressor;

(2) splitting refrigerant downstream of condenser into a main flow path and a secondary flow path, said secondary flow path bypassing said main expansion device and said evaporator, and passing the refrigerant in said secondary flow path through a secondary expansion device, said secondary flow path being recombined with said main flow path downstream of said evaporator, to be returned to said suction line leading to said compressor; and (3) said splitting of said refrigerant into said main flow path and said secondary flow path occurs downstream of said auxiliary heat exchanger, and said secondary expansion device is positioned downstream of said auxiliary heat exchanger.

11. A method of increasing performance in a refrigerant circuit comprising the steps of:

(1) providing a compressor having a discharge line leading to a condenser, the condenser having a line leading to an auxiliary heat exchanger, and a refrigerant flowing through said auxiliary heat exchanger passing to a main expansion device, then to an evaporator, and then from said evaporator returning refrigerant to a suction line leading to said compressor;

(2) splitting refrigerant downstream of condenser into a main flow path and a secondary flow path, said secondary flow path bypassing said main expansion device and said evaporator, and passing the refrigerant in said secondary flow path through a secondary expansion device, said secondary flow path being recombined with said main flow path downstream of said evaporator, to be returned to said suction line leading to said compressor; and (3) said splitting of said refrigerant into said main flow path and said secondary flow path occurs upstream of said auxiliary heat exchanger, and said expansion by said secondary expansion device also occurring upstream of said auxiliary heat exchanger.

* * * * *

UNITED STATES PATENT AND TRADEMARK OFFICE

CERTIFICATE OF CORRECTION

PATENT NO. : 6,826,918 B1
DATED : December 7, 2004
INVENTOR(S) : Taras et al.

It is certified that error appears in the above-identified patent and that said Letters Patent is hereby corrected as shown below:

Column 4,
Line 62, “though” should be -- through --.

Signed and Sealed this

Fifteenth Day of February, 2005

JON W. DUDAS
*Director of the United States Patent and Trademark Office*